US005142325A

United States Patent [19]

Kai et al.

[11] Patent Number: 5,142,325

[45] Date of Patent: Aug. 25, 1992

[54] IMAGE FORMING APPARATUS

[75] Inventors: Masami Kai, Kashihara; Toshinobu Katafuchi, Fujiidera; Hideyuki Tanaka, Itami; Toru Taniguchi, Hirakata; Syuji Yamada, Kobe; Takao Ichihashi, Toyonaka, all of Japan

[73] Assignee: Mita Industrial Co., Ltd., Japan

[21] Appl. No.: 845,252

[22] Filed: Mar. 3, 1992

[30] Foreign Application Priority Data

Mar. 9, 1991 [JP] Japan ..... 3-69057
Nov. 29, 1991 [JP] Japan ..... 3-342484

[51] Int. Cl.[5] ..... G03G 15/06; G03G 15/01

[52] U.S. Cl. ..... 355/207; 355/208; 355/246; 355/326

[58] Field of Search ..... 355/206, 207, 208, 246, 355/326, 327; 118/689, 691

[56] References Cited

U.S. PATENT DOCUMENTS 4,951,091 8/1990 Nawata ..... 355/206
4,952,976 8/1990 Kotoh et al. ..... 355/206
4,952,987 8/1990 Takano ..... 355/209
4,956,669 9/1990 Nakamura ..... 355/208
5,057,870 10/1991 Aoki ..... 355/246
5,070,362 12/1991 Noda ..... 355/206
5,070,368 12/1991 Akano et al. ..... 355/208 X
5,075,726 12/1991 Itaya et al. ..... 355/246
5,091,749 2/1992 Iida et al. ..... 355/208 X

*Primary Examiner*—Richard L. Moses
*Attorney, Agent, or Firm*—Beveridge, DeGrandi & Weilacher

[57] ABSTRACT

In an image forming apparatus in which toner is fed to a developer unit from a toner storage container through toner conveying means provided between the toner storage container and the developer unit, the image forming apparatus comprises a toner remaining amount detector for detecting not more than a predetermined amount of toner in the toner storage container, a toner density detector for detecting the density of toner in the developer unit, and means for interrupting the image forming operation to feed the toner to the developer unit from the toner storage container through the toner conveying means when the amount of the toner in the toner storage container is larger than the predetermined amount and the density detected by the toner density detector is lower than a predetermined density. Comsequently, suitable measures can be taken when there occurs such a state that no toner exists in the toner conveying means between the toner storage container and the developing mechanism even if the toner exists in the toner storage container.

13 Claims, 9 Drawing Sheets

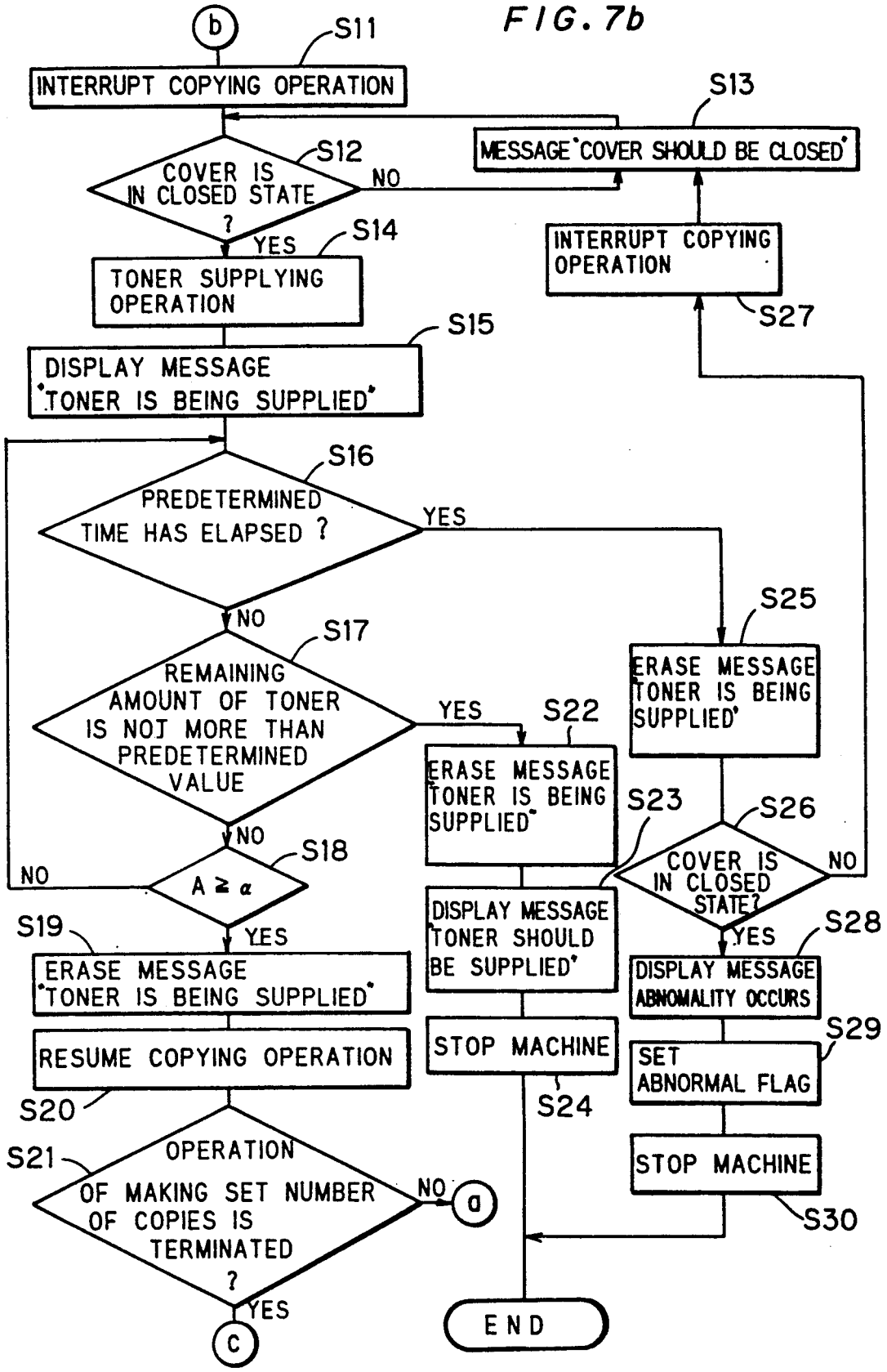
FIG. 7b
b
S11
INTERRUPT COPYING OPERATION
S12
COVER IS IN CLOSED STATE ?
NO
YES
S13
MESSAGE "COVER SHOULD BE CLOSED"
S14
TONER SUPPLYING OPERATION
INTERRUPT COPYING OPERATION
S27
S15
DISPLAY MESSAGE "TONER IS BEING SUPPLIED"
S16
PREDETERMINED TIME HAS ELAPSED ?
YES
NO
S25
ERASE MESSAGE "TONER IS BEING SUPPLIED"
S17
REMAINING AMOUNT OF TONER IS NOT MORE THAN PREDETERMINED VALUE
YES
S22
ERASE MESSAGE "TONER IS BEING SUPPLIED"
S23
S26
COVER IS IN CLOSED STATE?
NO
YES
NO
S18
A ≥ α
NO
YES
S19
ERASE MESSAGE "TONER IS BEING SUPPLIED"
DISPLAY MESSAGE "TONER SHOULD BE SUPPLIED"
S28
DISPLAY MESSAGE ABNOMALITY OCCURS
RESUME COPYING OPERATION
STOP MACHINE
S29
SET ABNORMAL FLAG
S20
S24
S21
OPERATION OF MAKING SET NUMBER OF COPIES IS TERMINATED ?
NO
a
STOP MACHINE
S30
YES
c
END

IMAGE FORMING APPARATUS

BACKGROUND OF THE INVENTION

1. Field of the Invention

The present invention relates to image forming apparatuses such as a copying machine and a printer.

2. Description of the Prior Art

In recent years, as a demand for a color image has been increased, a lot of electrostatic process color image forming apparatuses have been proposed and put into practice. In a typical example of the color image forming apparatuses, an electrostatic latent image is developed on an electrostatic photoreceptor provided on a rotary drum in each of, for example, four colors, that is, yellow, magenta, cyan and black colors and is transferred to paper, thereby to form a color image on the paper. The developing device in the above described color image forming apparatus must be a multicolor developing device capable of selectively developing an electrostatic latent image in, for example, the above described four colors.

Examples of the multicolor developing device conventionally known include one disclosed in Japanese Patent Laid-Open Gazette No. 148055/1990. The multicolor developing device comprises a plurality of developing mechanisms mounted on a movable frame which is moved back and forth in the vertical direction by moving means. When the movable frame is moved back and forth by the moving means, each of the developing mechanisms is selectively put in a position for development on the rotary drum to perform the developing function in any one of the above described different colors. Each of the developing mechanisms comprises a developer unit and a toner storage container for containing toner having any one of the different colors. The toner in the toner storage container is supplied to the developer unit by toner conveying means at the time of the developing function of the developing mechanism.

The above described conventional multicolor developing device has the following problems:

(1) Since the toner storage container is provided for each of the developing mechanisms mounted on the movable frame, a space is required for the toner storage container to move upward. Consequently, the capacity of the toner storage container is restrained to increase the number of times of the supply of toner to the toner storage container, and the color image forming apparatus is made large in size.

(2) Since the weight of the entire movable frame containing each of the developing mechanisms is increased, the inertia force due to the movement is increased and the the load applied on the moving means is increased. Consequently, it is very difficult to cope with higher speed, so that it takes long to switch the developing mechanisms. In addition, a large capacity motor is required for the movable frame.

(3) Since the capacity of the toner remaining in the toner storage container is changed, the load applied on the above described moving means at the time of driving and stopping the movable frame is changed, thereby to make it difficult to sufficiently ensure the precision of, for example, the positioning, the operation and the stop of each of the developing mechanisms.

On the other hand, a multicolor developing device having a toner storage container positioned above a developing mechanism for supplying toner to a developer unit through a flexible tube containing a spiral has been known. In a color image forming apparatus having the multicolor developing device, however, a space is required to dispose the toner storage container above the uppermost position to which the developer unit is moved, so that &he entire color image forming apparatus is made large in size. Moreover, a significantly useless space is formed below the toner storage container.

The applicant of the present invention has developed an image forming apparatus having a multicolor developing device shown in FIGS. 1 and 2 capable of sufficiently ensuring the capacity of a toner storage container as well as sufficiently ensuring the precision of, for example, the positioning of each of developing mechanisms while increasing the switching speed of the developing mechanism.

The details of the multicolor developing device shown in FIGS. 1 and 2 will be described in the embodiments. The multicolor developing device shown in FIGS. 1 and 2 comprises toner conveying means 40 for supplying toner to a developer unit 6 from a toner storage container 32. The toner conveying means 40 comprises a cylindrical member 44 extending upward in the vertical direction from the lower end of the toner storage container 32, a spiral roller 46 disposed in the cylindrical member 44 so as to extend along the cylindrical member 44 and so constructed as to feed the toner flowing into the cylindrical member 44 from the lower end of the toner storage container 32 to the upper end of the cylindrical member 44, and toner drop passage means 48 connecting the upper end of the cylindrical member 44 and the developer unit 6 and for supplying the toner fed to the upper end of the cylindrical member 44 to the developer unit 6.

In the multicolor developing device, such a state may occur that no toner exists in the intermediate part of the cylindrical member 44 even if the toner is supplied to the toner storage container 32, depending on the method of supplying the toner.

Some copying machine may be provided with an opening for toner supply for supplying toner to a toner storage container in its main body as well as a cover for toner supply covering the opening. In supplying toner, a user opens the cover, to supply toner to the toner storage container in the main body of the copying machine from a toner bottle. Alternatively, the user mounts a toner cartridge on the toner storage container in the main body of the copying machine, to supply toner to the toner storage container.

A rotating blade for toner supply for feeding the toner in the toner storage container toward a developer unit is generally provided in the toner storage container in the main body of the copying machine. Accordingly, when the user supplies toner during the copying operation in which the rotating blade for toner supply is driven, user's fingers may be brought into contact with the rotating blade for toner supply, which is very dangerous. Therefore, a method is considered of inhibiting the copying operation by, for example, tuning off the power supply of the copying machine when the cover is opened, as used in the copying machine of such a type conventionally well-known as to supply toner by opening a front door covering almost all of its front surface. However, this method reduces the operating efficiency of the copying machine.

SUMMARY OF THE INVENTION

An object of the present invention is to provide an image forming apparatus capable of taking suitable measures when there occurs such a state that no toner exists in the intermediate part of toner conveying means even if toner is supplied to a toner storage container.

Another object of the present invention is to provide an image forming apparatus which can safely supply toner and is not decreased in operating efficiency.

In a first image forming apparatus according to the present invention in which toner is fed to a developer unit from a toner storage container through toner conveying means provided between the toner storage container and the developer unit, the image forming apparatus is characterized by comprising a toner remaining amount detector for detecting not more than a predetermined amount of toner in the toner storage container, a toner density detector for detecting the density of toner in the developer unit, and means for interrupting the image forming operation to feed the toner to the developer unit from the toner storage container through the toner conveying means when the amount of the toner in the toner storage container is larger than the predetermined amount and the density detected by the toner density detector is lower than a predetermined density.

In the first image forming apparatus according to the present invention, the image forming operation is interrupted so that the toner is fed to the developer unit from the toner storage container through the toner conveying means when the amount of the toner in the toner storage container is larger than the predetermined amount and the density detected by the toner density detector is lower than the predetermined density.

In the first image forming apparatus according to the present invention, suitable measures can be taken when there occurs such a state that no toner exists in the toner conveying means between the toner storage container and the developer unit even if the toner exists in the toner storage container.

When toner agitating means for agitating toner is provided in the developer unit, it is preferable to drive the toner agitating means in the developer unit when the toner is fed to the developer unit from the toner storage container through the toner conveying means. In addition, it is preferable to report that toner is being supplied while the toner is fed to the developer unit from the toner storage container through the toner conveying means.

Furthermore, when the amount of the toner in the toner storage container is not more than the predetermined amount before a predetermined time has elapsed since the toner started to be fed to the developer unit from the toner storage container through the toner conveying means, it is preferable to stop the image forming apparatus as well as to report that toner should be supplied.

In a second image forming apparatus according to the present invention in which toner is fed to a developer unit from a toner storage container through toner conveying means provided between the toner storage container and the developer unit, the image forming apparatus is characterized by comprising a toner remaining amount detector for detecting not more than a predetermined amount of toner in the toner storage container, a toner density detector for detecting the density of toner in the developer unit, means for interrupting the image forming operation to feed the toner to the developer unit from the toner storage container through the toner conveying means when the amount of the toner in the toner storage container is larger than the predetermined amount and the density detected by the toner density detector is lower than a predetermined density, and means for stopping the image forming apparatus when the density detected by the toner density detector is lower than the above described predetermined density at the time point where a predetermined time has elapsed since the toner started to be fed to the developer unit from the toner storage container through the toner conveying means.

In the second image forming apparatus according to the present invention, the image forming operation is interrupted so that the toner is fed to the developer unit from the toner storage container through the toner conveying means when the amount of the toner in the toner storage container is larger than the predetermined amount and the density detected by the toner density detector is lower than the predetermined density. The image forming apparatus is stopped when the density detected by the toner density detector is lower than the above described predetermined density at the time point where a predetermined time has elapsed since the toner started to be fed to the developer unit from the toner storage container through the toner conveying means.

In the second image forming apparatus according to the present invention, suitable measures can be taken when there occurs such a state that no toner exists in the toner conveying means between the toner storage container and the developer unit even if the toner exists in the toner storage container.

It is preferable to stop the image forming apparatus as well as to report that an abnormality occurs when the density detected by the toner density detector is lower than the predetermined density at the time point where a predetermined time has elapsed since the toner started to be fed to the developer unit from the toner storage container through the toner conveying means.

Furthermore, there may be provided a rotating blade for toner supply disposed in the above described toner storage container and for feeding the toner in the toner storage container to the above described toner conveying means, an opened or closed state detector for detecting the opened or closed state of a cover covering an opening for toner supply provided for the main body of the image forming apparatus for supplying toner to the toner storage container, and means for bringing the rotating blade for toner supply provided in the toner storage container into a driving inhibited state when the opened or closed state detector detects the opened state of the cover.

In a third image forming apparatus according to the present invention in which a rotating blade for toner supply for feeding toner in a toner storage container toward a developer unit is disposed in the toner storage container, and the toner is fed to the developer unit from the toner storage container, the image forming apparatus is characterized by comprising an opened or closed state detector for detecting the opened or closed state of a cover covering an opening for toner supply provided for the main body of the image forming apparatus for supplying toner to the toner storage container, and means for bringing the rotating blade for toner supply provided in the toner storage container into a driving inhibited state when the opened or closed state detector detects the opened state of the cover.

In the third image forming apparatus according to the present invention, the toner is fed to the developer unit from the toner storage container. There is provided the opened or closed state detector for detecting the opened or closed state of the cover covering the opening for toner supply provided for the main body of the image forming apparatus for supplying toner to the toner storage container, and the rotating blade for toner supply provided in the toner storage container is brought into a driving inhibited state when the opened or closed state detector detects the opened state of the cover.

In the third image forming apparatus according to the present invention, when the cover to be opened in supplying toner is opened, the driving of the rotating blade in the toner storage container is inhibited, to make it possible to safely perform the toner supplying work. In addition, since the image forming operation is not automatically interrupted or inhibited when the cover is opened, the operating efficiency of the image forming apparatus is not decreased.

In a fourth image forming apparatus according to the present invention in which toner in a toner storage container is fed to a developer unit by a rotating blade for toner supply in the toner storage container and toner conveying means provided between the toner storage container and the developer unit, the image forming apparatus is characterized by comprising an opened or closed state detector for detecting the opened or closed state of a cover covering an opening for toner supply provided for the main body of the image forming apparatus for supplying toner to the toner storage container, and means for bringing the rotating blade for toner supply into a driving inhibited state when the opened or closed state detector detects the opened state of the cover.

In the fourth image forming apparatus according to the present invention, the toner in the toner storage container is fed to the developer unit by the rotating blade for toner supply in the toner storage container and the toner conveying means provided between the toner storage container and the developer unit. There is provided the opened or closed state detector for detecting the opened or closed state of the cover covering the opening for toner supply provided for the main body of the image forming apparatus for supplying toner to the toner storage container, and the rotating blade for toner supply is brought into a driving inhibited state when the opened or closed state detector detects the opened state of the cover.

In the fourth image forming apparatus according to the present invention, when the cover to be opened in supplying toner is opened, the driving of the rotating blade in the toner storage container is inhibited, thereby to make it possible to safely perform the toner supplying work. In addition, since the image forming operation is not automatically interrupted or inhibited when the cover is opened, the operating efficiency of the image forming apparatus is not decreased.

There are preferably provided a toner remaining amount detector for detecting not more than a predetermined amount of toner in the above described toner storage container, a toner density detector for detecting the density of toner in the above described developer unit, first opened or closed state judging means for judging the opened or closed state of the above described cover on the basis of the above described opened or closed state detector when the amount of the toner in the toner storage container is larger than a predetermined amount and the density detected by the toner density detector is lower than a predetermined density, first toner supplying means for driving the above described rotating blade for toner supply and the above described toner conveying means when the first opened or closed state judging means judges that the above described cover is in its closed state, and second toner supplying means for reporting that the cover should be closed when the first opened and closed state judging means judges that the cover is in its opened state and driving the rotating blade for toner supply and the toner conveying means when the cover is in its closed state. In this case, it is preferable to provide image forming operation interrupting means for interrupting the image forming operation when the amount of the toner in the toner storage container is larger than the predetermined amount and the density detected by the toner density detector is lower than the above described predetermined density.

Furthermore, there may be provided second opened or closed state judging means for judging the opened or closed state of the above described cover on the basis of the above described opened or closed state detector when the density detected by the above described toner density detector is lower than the above described predetermined density at the time point where a predetermined time has elapsed since the above described rotating blade for toner supply and the above described toner conveying means were driven by the above described first or second toner supplying means, stopping means for stopping the image forming apparatus when the second opened or closed state judging means judges that the cover is in its closed state, and third toner supplying means for reporting that the cover should be closed when the second opened or closed state judging means judges that the cover is in its opened state and driving the rotating blade for toner supply and the toner conveying means when the cover is in its closed state.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 7*a* and 7*b* are flow charts showing another example of toner supply control processing by a CPU.

DESCRIPTION OF THE PREFERRED EMBODIMENTS

Description is now made of embodiments of the present invention which is applied to a copying machine having a multicolor developing device.

FIGS. 1 to 5 show a first embodiment of the present invention.

Figure 1:
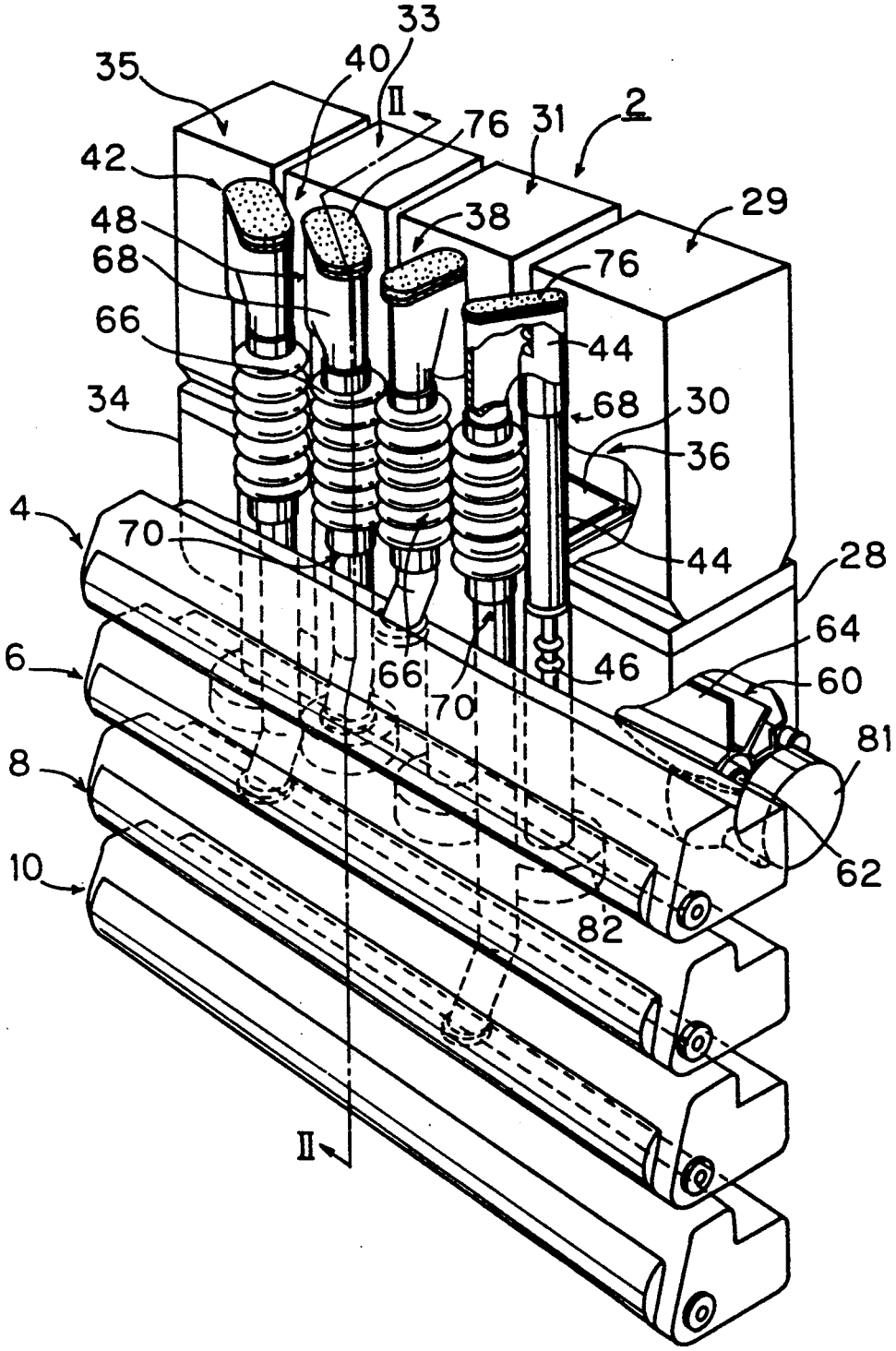
FIG. 1 is a perspective view showing a multicolor developing device.
Figure 2:
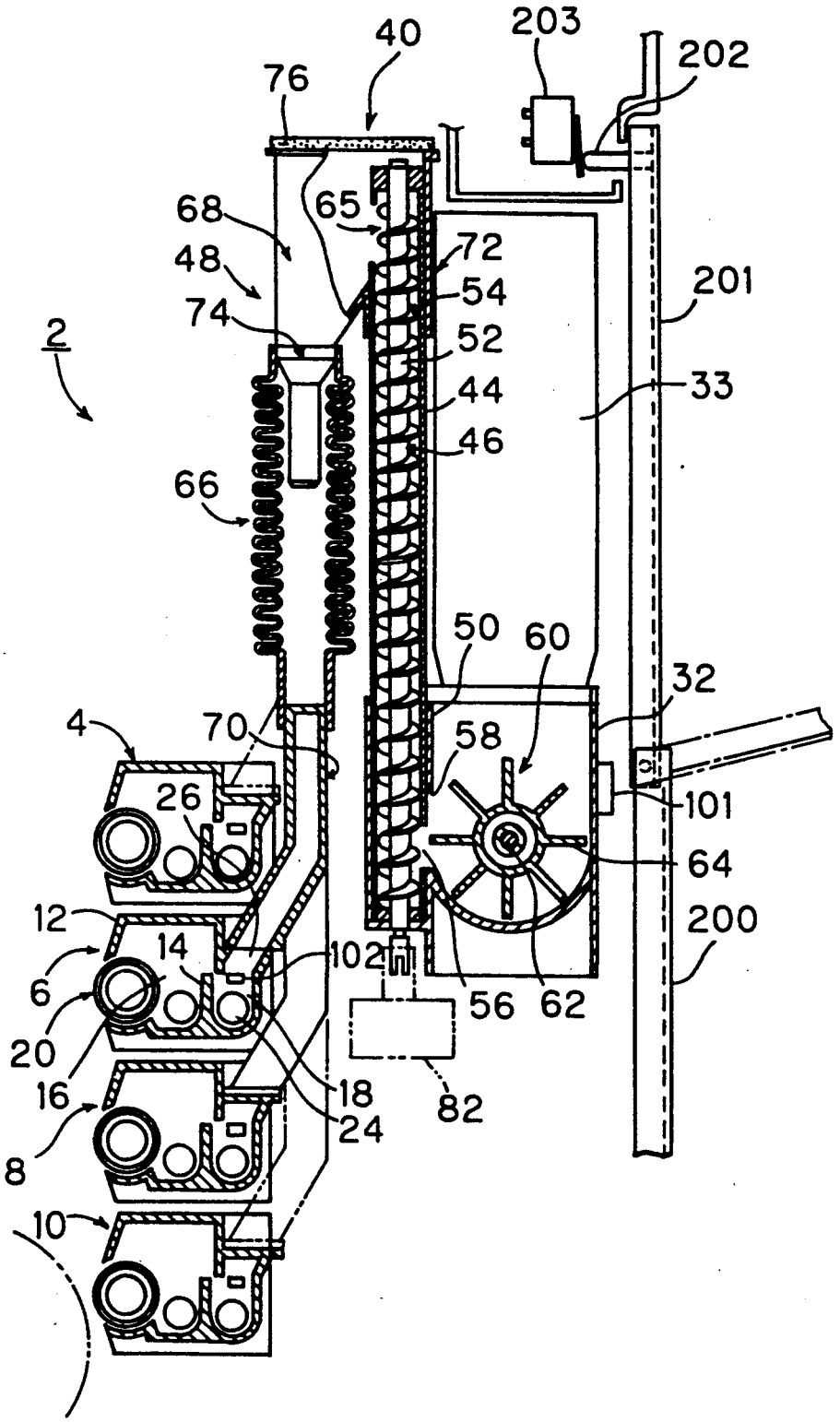
FIG. 2 is a cross sectional view taken along a line II—II shown in FIG. 1.

In FIGS. 1 and 2, a multicolor developing device 2 comprises a stationary frame and a movable frame mounted on the stationary frame so as to be movable back and forth in the vertical direction by moving means (which are not shown).

The entire stationary frame is constituted by a housing in a rectangular pallelopiped shape. The entire movable frame is constituted by a housing in a substantially rectangular pallelopiped shape. The movable frame is attached to the stationary frame so as to be movable back and forth in the vertical direction along a guide rail (not shown) provided in the stationary frame.

In this example, four developer units 4, 6, 8 and 10 are mounted in descending order on the movable frame with predetermined spacing in the vertical direction. The developer units 4, 6, 8 and 10 respectively house developers containing cyan toner, Yellow toner, magenta toner and black toner. The developer comprises, for example, toner and a carrier. The basic structures of the respective developer units are substantially the same except for a part as described later and hence, the The developer unit 6 comprises a housing 12. In the housing 12, two chambers 16 and 18 are formed by a partition wall 14 provided along its length. The chambers 16 and 18 communicate with each other through a communication path (not shown) in both ends of the partition wall 14. A sleeve 20 and a spiral roller 22 for agitating and circulating the developer are disposed in the chamber 10, and a spiral roller 24 for agitating and circulating the developer is disposed in the chamber 18.

The sleeve 20 is rotatably supported on the housing 12, and a part of its peripheral surface is projected from an opening provided along the left end of the housing 12. When the developer unit 6 is put in a predetermined position for development, the above described projected peripheral surface of the sleeve 20 approaches a position for development on a rotary drum (see a two-dot and dash line in FIG. 2) provided for the stationary frame to supply the toner to the surface of the rotary drum, so that the developing function is performed.

The spiral rollers 22 and 24 are rotatably supported so as to extend in parallel with each other along the length of the chambers 16 and 18 in the housing 12. The sleeve 20, and the spiral rollers 22 and 24 are respectively connected to a driving motor 83 (see FIG. 4) through a gear train (not shown) and are so constructed as to be simultaneously rotated and driven. When the spiral rollers 22 and 24 are rotated, the developer in the chamber 16 and the developer in the chamber 18 are fed in opposite directions along the length of the chambers 16 and 18. Consequently, the developer in the housing 12 is circulated while being agitated.

A toner inlet opening 26 for receiving toner supplied from toner conveying means as described later is formed in the upper position of the chamber 18 in the housing 12. The toner inlet opening 26 is disposed in a position near the upstream side of the spiral roller 24.

The movable frame is moved by the moving means to selectively put the developer units 4, 6, 8 and 10 in a predetermined position for development, to perform the developing function in different colors.

Toner storage containers 28, 30, 32 and 34 which are equal in number to the developer units 4, 6, 8 and 10 are arranged in the horizontal direction and fixed to the stationary frame on the side of the right end of the movable frame. The toner storage containers 28, 30, 32 and 34 respectively house black toner, cyan toner, yellow toner and magenta toner. The toner storage containers 28, 30, 32 and 34 are mounted on a supporting frame (not shown) provided for the stationary frame. Toner cartridges 29, 31, 33 and 35 are respectively mounted on the toner storage containers 28, 30, 32 and 34.

An opening for replacing the toner cartridges 29, 31, 33 and 35 is provided on a right side surface 200 of a case of the copying machine, and a cover 201 for closing the opening is attached to the right side surface 200 of the case such that it can be freely opened and closed. In addition, an opened or closed state detecting switch 203 (opened or closed state detector) which is turned on by the pressing of an inward projection 202 provided for the cover 201 when the cover 201 is in its closed state while being turned off by the release from the pressing of the inward projection 202 when the cover 201 is in its opened state is provided in the copying machine.

Toner conveying means 36, 38, 40 and 42 for supplying toner in the respective toner storage containers 287, 30, 32 and 34 to the developer units 4, 6, 8 and 10 corresponding to the toner storage containers 28, 30, 32 and 34 are respectively provided between the toner storage containers 28, 30, 32 and 34 and the developer units 4, 6, 8 and 10.

The respective basic structures in the toner storage containers 28, 30, 32 and 34 and the toner conveying means 36, 38, 40 and 42 are substantially the same except for the layout. Accordingly, the toner storage container 32 and the toner conveying means 40 provided associated therewith will be described by way of example.

The toner conveying means 40 comprises a cylindrical member 44 extending upward in the vertical direction from the lower end of the toner storage container 32, a spiral roller 46 disposed in the cylindrical member 44 so as to extend along the cylindrical member 44 and for feeding toner flowing into the cylindrical member 44 from the lower end of the toner storage container 32 to the upper end of the cylindrical member 44, and a toner drop passage means connecting the upper end of the cylindrical member 44 and the developer unit 6 and for supplying the toner fed to the upper end of the cylindrical member 44 to the developer unit 6.

A supporting portion 50 in a cylindrical shape is formed in one side part (on the left side of FIG. 2) of the toner storage container 32, and the lower end of the cylindrical member 44 is inserted into the supporting portion 50 and supported thereon, the spiral roller 46 comprises a shaft 52 rotatably supported on bearings provided in the upper and lower ends of the cylindrical member 44 and a spiral member 54 provided for the shaft 52. The shaft 52 is projected downward from the lower end of the cylindrical member 44 and is connected to a motor 82 serving as a driving source. The motor 82 is driven at the time of the toner supplying operation.

A toner inlet opening 56 is formed in the lower end of the cylindrical member 44. An opening 58 is formed in a portion, which corresponds to the toner inlet opening 56, of the supporting portion 50 in the toner storage container 32. A rotating blade 60 for forcedly feeding the toner stored in the toner storage container 32 into the lower end of the cylindrical member 44 is provided inside of bottom part of the toner storage container 32.

The rotating blade 60 comprises an axis of rotation 62 extending through the toner storage container 32 and a plurality of blades 64 provided for the axis of rotation 62. The rotating blade 60 is connected to a motor 81 serving as a driving source. The motor 81 is generally driven at the time of the copying operation and at the time of the toner supplying operation. When the rotating blade 60 is rotated, the toner in the toner storage container 32 is forcedly fed into the lower end of the cylindrical member 44 through the opening 58 and the toner inlet opening 56.

The toner drop passage means 48 includes a bellows 66 serving as expandable and contractible means which is disposed so as to extend substantially in the direction in which the developer unit 6 is moved (in the vertical direction). The toner drop passage means 48 further comprises a connecting housing 68 disposed between the upper end of the cylindrical member 44 and the upper end of the bellows 66 and for dropping the toner fed to the upper end of the cylindrical member 44 into the bellows 66, and a connecting pipe 70 connecting the lower end of the bellows 66 and the developer unit 6 and for dropping the toner dropped into the bellows 66 into the developer unit 6 and supplying the same to the developer unit 6.

A cylindrical portion 72 connected to the upper end of the cylindrical member 44 is formed below one end of the connecting housing 68, and another cylindrical portion 74 to which the upper end of the bellows 66 is connected is formed in the other end of the connecting housing 68. A discharge opening is formed in the upper end of the connecting housing 68. A filter 76 for preventing the toner from being discharged from the discharge opening is attached to the discharge opening. A toner outlet opening 65 for causing the toner fed by the spiral roller 46 to flow out into the connecting housing 68 is formed in the upper end of the cylindrical member 44.

In the above described construction, the movable frame is moved back and forth in the vertical direction by the moving means, depending on the copying operation. The developer units 4, 6, 8 and 10 are selectively put in a predetermined position for development and are so controlled as to perform the developing function in different colors. When the movable frame is moved by the moving means to put the developer unit 6 in the predetermined position for development, the sleeve 20 and the spiral rollers 22 and 24 in the developer unit 6 are rotated by the driving source, so that the developing function is performed.

On the other hand, at the time of the toner supplying operation, the motors 81, 82 and 83 are driven, so that the rotating blade 60, the spiral roller 46 and the spiral rollers 22 and 24 are rotated. Consequently, the toner in the toner storage container 32 is fed into the lower end of the cylindrical member 44 by the rotating blade 60 and is fed to the connecting housing 68 by the spiral roller 46. The toner fed to the connecting housing 68 is dropped through the bellows 66 and the connecting pipe 70, to be supplied to the chamber 18 in the housing 12. In the housing 12, the toner is agitated by the spiral rollers 22 and 24.

When a predetermined developing function of the developer unit 6 is completed, the movable frame starts to be moved, so that any one of the other developer units 4, 8 and 10 is selected and put in a predetermined position for development. The same operation as described above is then performed.

The toner supply control of the developing device will be described. Description is made by taking as an example the toner storage container 32, the toner conveying means 40 provided associated therewith, and the developer unit 6 provided associated therewith.

The toner storage container 32 is provided with a toner remaining amount detector 101 for detecting not more than a predetermined amount of toner in the toner storage container 32. In addition, a toner density detector 102 for detecting the toner density is provided in the housing 12.

Figure 3:
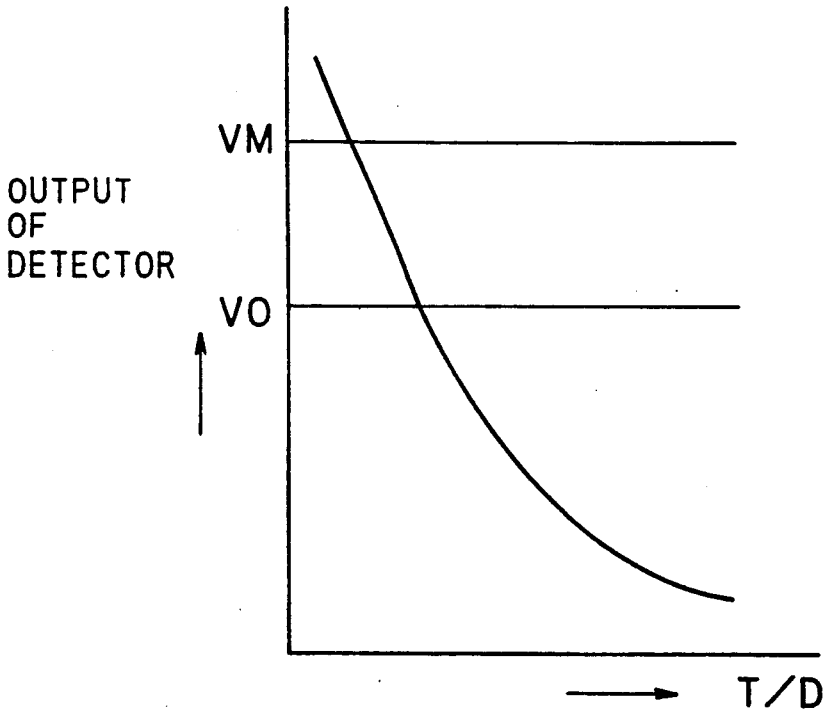
FIG. 3 is a graph showing output characteristics of a toner density detector.

FIG. 3 shows output characteristics of the toner density detector 102. The larger the toner density is, the smaller an output of the toner density detector 102 becomes. In FIG. 3, VO denotes an output voltage of the toner density detector 102 relative to a density $\alpha$ in the center of a suitable toner density range (hereinafter referred to as control reference density). In addition, VM denotes an output voltage of the toner density detector 102 relative to a density for judging copy inhibition $\beta$ ($\alpha > \beta$).

Figure 4:
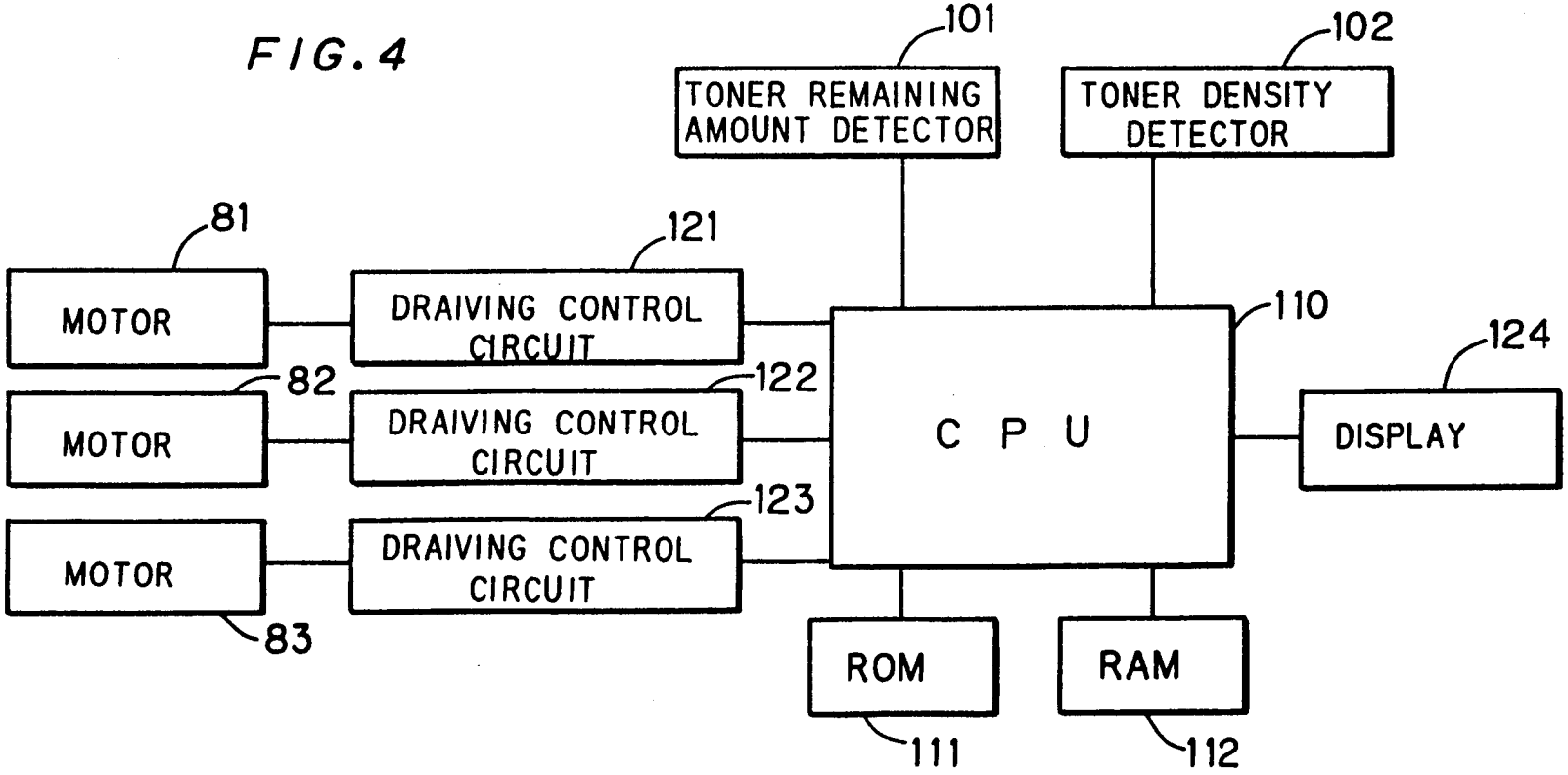
FIG. 4 is a electrical block diagram showing a toner supply control circuit.

FIG. 4 shows a toner supply control circuit. Toner supply control processing is performed by a CPU 110. The CPU 110 comprises a ROM 111 for storing its program and the like, and a RAM 112 for storing necessary data.

Detection signals from the toner remaining amount detector 101 and the toner density detector 102 are sent to the CPU 110. A control signal is sent from the CPU 110 to a driving control circuit 121 of the motor 81 for driving the rotating blade 60, a driving control circuit 122 of the motor 82 for driving the spiral roller 46, a driving control circuit 123 of the motor 83 for driving the spiral rollers 22 and 24, and a display device 124.

Figure 5A:
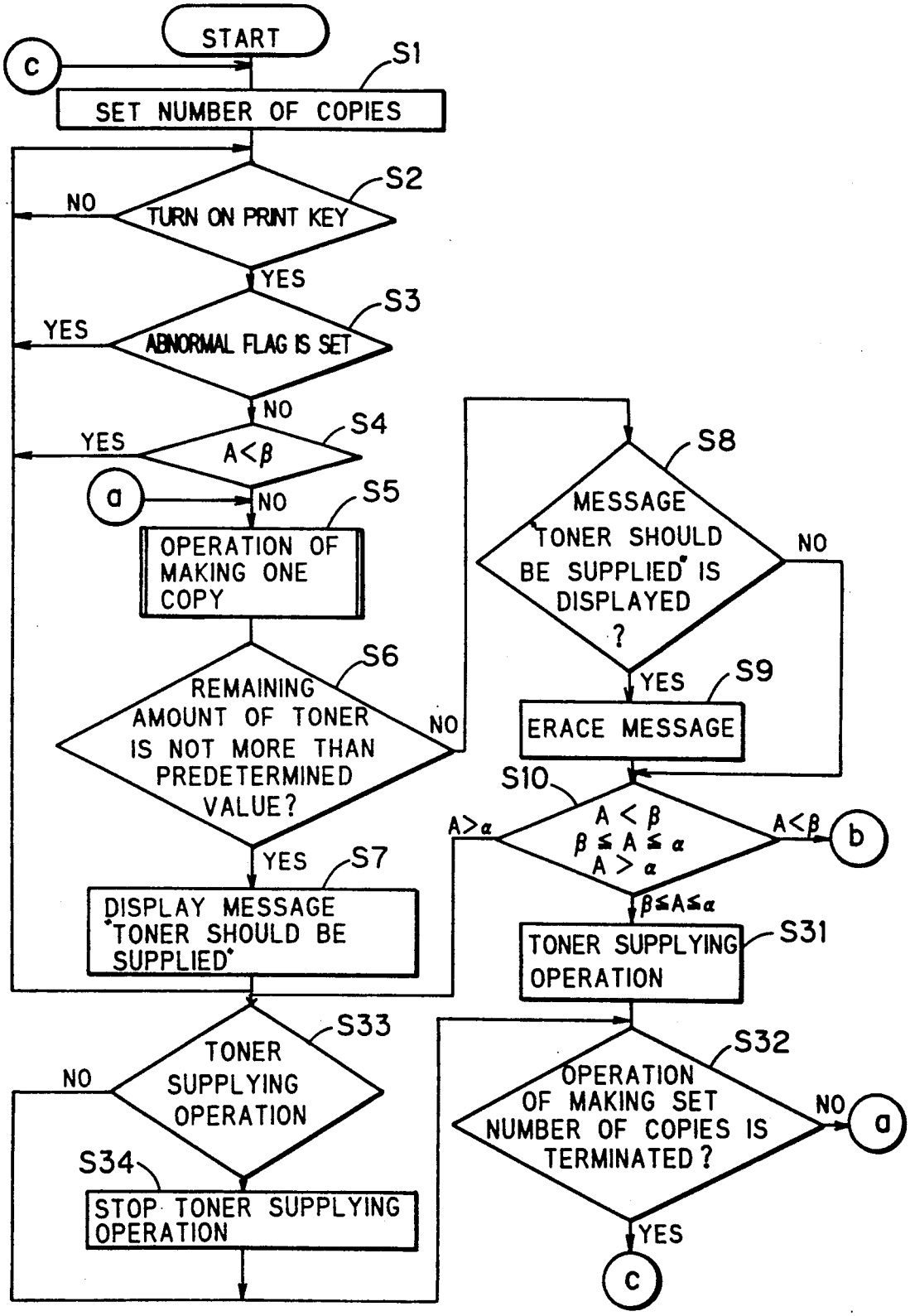
FIGS. 5*a* and 5*b* are flow charts showing the procedure for toner supply control processing by a CPU.
Figure 5B:
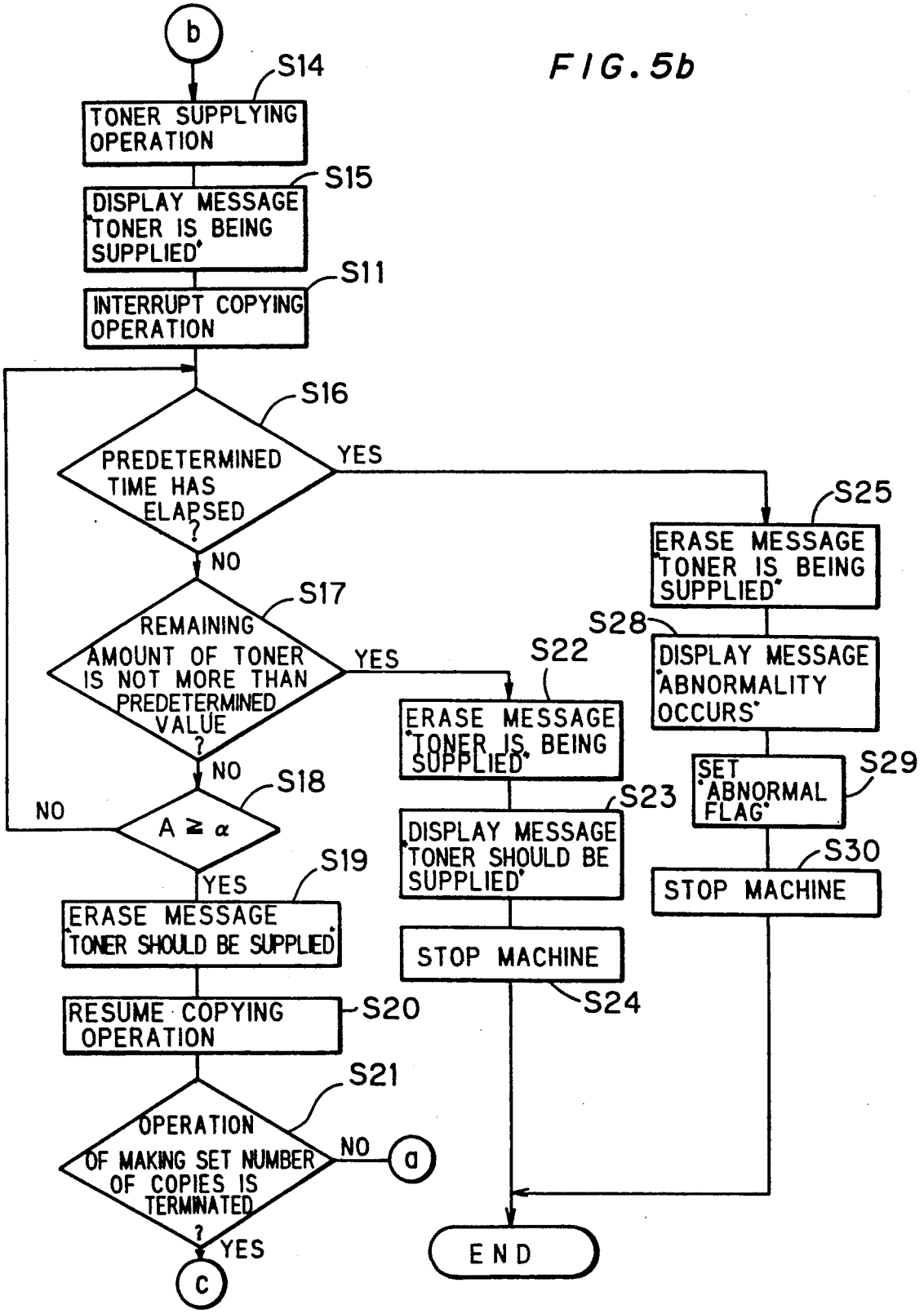

FIGS. 5*a* and 5*b* show the procedure for the toner supply control processing by the CPU 110.

When the number of copies is set after the power supply of the copying machine is turned on (step S1), and a print keV is turned on (step S2), it is judged whether or not an abnormal flag as described later is set (step S3). If the abnormal flag is set, the program is returned to the step S2, that is, copying is inhibited.

When the abnormal flag is not set, it is judged whether or not a toner density A detected by the toner density detector 102 is less than the density for judging copy inhibition $\beta$ (step S4). If the detected toner density A is less than the density for judging copy inhibition $\beta$ ($A < \beta$), the program is returned to the step S2, that is, copying is inhibited.

If the detected toner density A is not less than the density for judging copy inhibition $\beta$, the operation of making one copy is performed (step S5). It is judged on the basis of the detection signal of the toner remaining amount detector 101 whether or not the amount of toner in the toner storage container 32 is not more than a predetermined value (step S6). If the amount of toner in the toner storage container 32 is not more than a predetermined value, a message describing that toner should be supplied is displayed on the display device 124 (step S7), so that the program is returned to the step S2. In this case, even if the set number of copies is plural, continuous copying is inhibited. However, it is possible to make copies one at a time by the operation of the print key.

If the amount of the toner in the toner storage container 32 is larger than a predetermined value in the step S6, it is judged whether or not a message describing that toner should be supplied is displayed on the display device 124 (step S8). If the message is displayed, the message is erased (step S9) and then, it is judged whether the toner density A detected by the toner density detector 102 is less than the density for judging copy inhibition $\beta$ ($A<\beta$), is not less than the density for judging copy inhibition $\beta$ nor more than the control reference density $\alpha$ ($\beta \leqq A \leqq \alpha$), or is more than the control reference density $\alpha$ ($A>\alpha$) (step S10).

If the message describing that toner should be supplied is not displayed in the step S8, the program proceeds to the step S10. In the step S10, it is judged whether the toner density A detected by the toner density detector 102 is less than the density for judging copy inhibition ($A<\beta$). is not less than the density for judging copy inhibition nor more than the control reference density $\alpha(\beta \leqq A \leqq \alpha)$ , or is more than the control reference density $\alpha(A>\alpha)$.

When the toner density A detected by the toner density detector 102 is less than the density for judging copy inhibition ($A<\beta$) in the step S10, the toner supplying operation is started (step S14). Such a situation occurs when copies continue to be made without replacing the toner cartridge 33 with a new one after the amount of the toner in the toner storage container 32 is not more than the predetermined value, and the toner cartridge 33 is replaced with a new one after there occurs a state where no toner exists in the cylindrical member 44.

The toner supplying operation is performed by driving the motors 81, 82 and 83 and driving the rotating blade 60, the spiral roller 46 and the spiral rollers 22 and 24. At the time of the toner supplying operation, a message describing that toner is being supplied is displayed on the display device 124 (step S15), and the copying operation is interrupted (step S11). In addition, it is judged whether or not a predetermined time, for example, two minutes has elapsed since toner started to be supplied (step S16). Unless a predetermined time has elapsed, it is judged on the basis of the detection signal of the toner remaining amount detector 101 whether or not the amount of the toner in the toner storage container 32 is not more than the predetermined value (step S17). If the amount of the toner in the toner storage container 32 is not more than the predetermined value, it is judged whether or not the toner density A detected by the toner density detector 102 is not less than the control reference density $\alpha$ (step S18). If the detected toner density A is less than the control reference density $\alpha$ ($A<\alpha$), the program is returned to the step S16, so that the processing in the steps S16 to S18 is repeated.

In a case where the processing in the steps S16 to S18 is performed, when the detected toner density A is not less than the control reference density $\alpha$ ($A \geqq \alpha$) in the step S18, the message describing that toner is being supplied is erased (step S19), and the copying operation is resumed (step S20). In this case, if the operation of making a set number of copies is not terminated (step S21), the program is returned to the step S5, so that the operation of making one copy is performed. If the operation of making a set number of copies is terminated (step S21), the program is returned to the step S1.

In a case where the processing in the steps S16 to S18 is performed, when the amount of the toner in the toner storage container 32 is not more than the predetermined value in the step S17, the message describing that toner is being supplied is erased (step S22), and a message describing that toner should be supplied is displayed on the display device 124 (step S23). In addition, the copying machine is stopped (step S24), so that this processing is terminated. In this case, the toner cartridge 33 is replaced with a new one by a user to supply toner to the toner storage container 32, so that the copying machine enters a copying enabled state.

In a case where the processing in the steps 516 to 518 is performed, when it is judged in the step S16 that a predetermined time has elapsed since toner started to be supplied, the message describing that toner is being supplied is erased (step S25), a message describing that an abnormality occurs is displayed on the display device 124 (step S28), and the abnormal flag is set (step S29). In addition, the copying machine is stopped (step S30), so that this processing is terminated. In this case, fault repair processing is performed by a service man. The abnormal flag is reset after the fault repair processing.

When in the above described step S10, the toner density A detected by the toner density detector 102 is not less than the density for judging copy inhibition $\beta$ nor more than the control reference density $\alpha$($\beta \leqq A \leqq \alpha$), the toner supplying operation is started (step S31). The toner supplying operation is performed by driving the motors 81, 82 and 83 and driving the rotating blade 60, the spiral roller 46 and the spiral rollers 22 and 24.

In this case, the copying operation is performed, as usual. If the operation of making a set number of copies is not terminated (step S32), the program is returned to the step S5, so that the operation of making the next one copy is performed. If the operation of making a set number of copies is terminated (step S32), the program is returned to the step S1.

When in the above described step S10, the toner density A detected by the toner density detector 102 is more than the control reference density $\alpha(A>\alpha)$, it is judged whether or not the toner supplying operation is performed (step S33). If the toner supplying operation is performed (step S33), the toner supplying operation is stopped (step S34). If the operation of making a set number of copies is not terminated (step S32). the program is returned to the step S5, so that the operation of making the next one copy is performed. If the operation of making a set number of copies is terminated (step S32), the program is returned to the step S1.

If the toner supplying operation is not performed in the step S31, the program proceeds to the step S32. In the step S32, it is judged whether or not the operation of making a set number of copies is terminated. If the operation of making a set number of copies is not terminated, the program is returned to the step S5, so that the operation of making one copy is performed. If the operation of making a set number of copies is terminated, the program is returned to the step S1.

According to the above described first embodiment, suitable measures can be taken when there occurs a state where no toner exists in the toner conveying means between the toner storage container 32 and the developer unit 6 even if the toner exists in the toner storage container 32.

Figure 6:
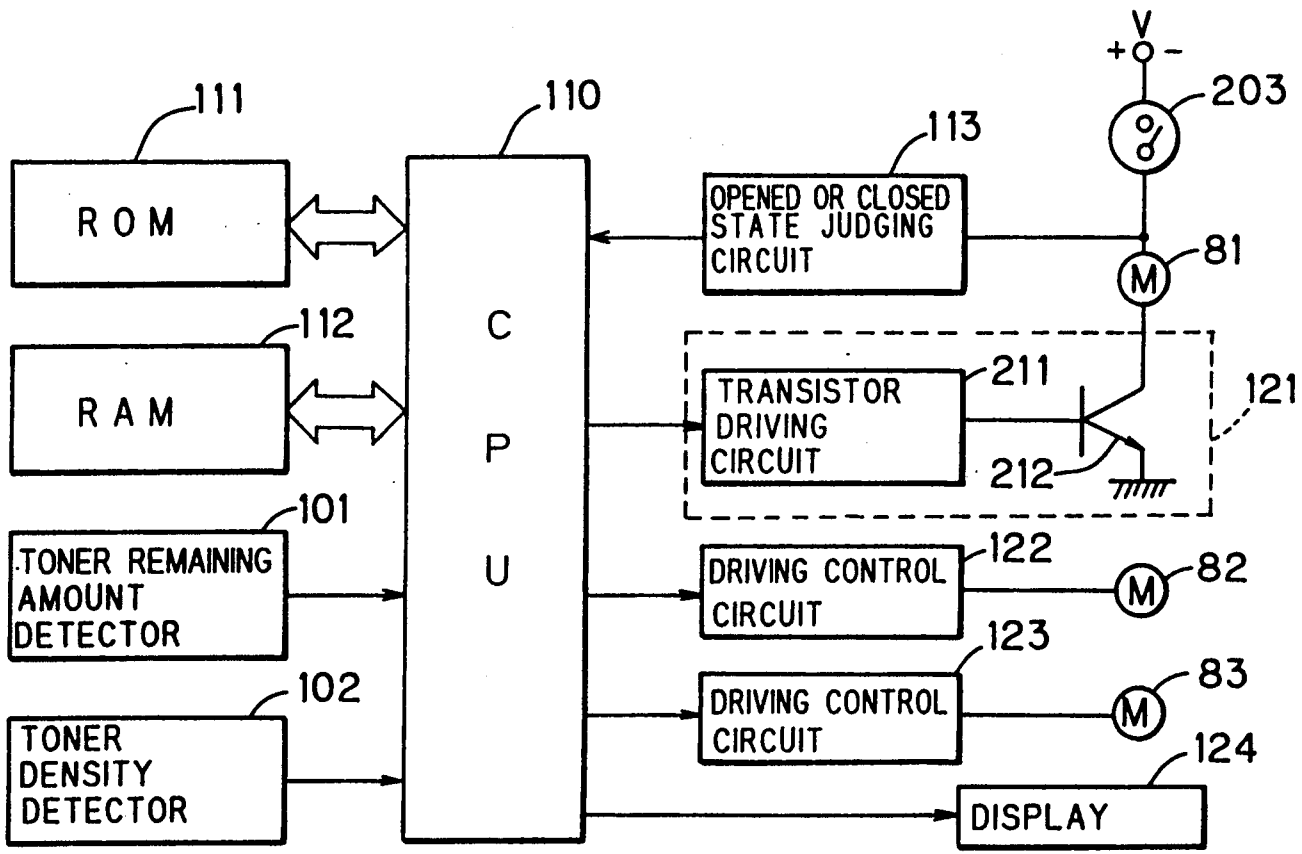
FIG. 6 is an electrical block diagram showing another example of the toner supply control circuit.

FIGS. 6 and 7 show a second embodiment of the present invention. The mechanism of the copying machine according to the second embodiment is the same as that shown in FIGS. 1 and 2, and the output characteristics of the toner density detector 102 are the same as those shown in FIG. 3.

FIG. 6 shows the electrical construction of the copying machine. In FIG. 6, the same portions as those shown in FIG. 4 are assigned the same reference numerals and hence, the description there of is not repeated.

An opened or closed state detecting switch 203 is connected between a motor 81 and a DC power supply Vc, and a switching transistor 212 is connected between the motor 81 and the ground. The switching transistor 212 and a driving circuit of the switching transistor 212 constitute a driving control circuit 121 of the motor 81. Consequently, when a cover 201 enters its opened state, the opened or closed state detecting switch 203 is turned off, so that the motor 81 enters a driving inhibited state. If the cover 201 enters its closed state, the opened or closed state detecting switch 203 is turned on, so that the motor 81 enters a driving enabled state.

The motor 81 and a terminal, which is connected to the motor B1, of the opened or closed state detecting switch 203 are connected to an opened or closed state judging circuit 113. The opened or closed state judging circuit 113 judges the opened or closed state of the cover 201 on the basis of an input signal, to output an opened or closed state judgement signal. The opened or closed state judgement signal Outputted from the opened or closed state judging circuit 113 is inputted to a CPU 110. Consequently, the CPU 110 can know the opened or closed state of the cover 201 from the opened or closed state judgement signal.

Figure 7A:
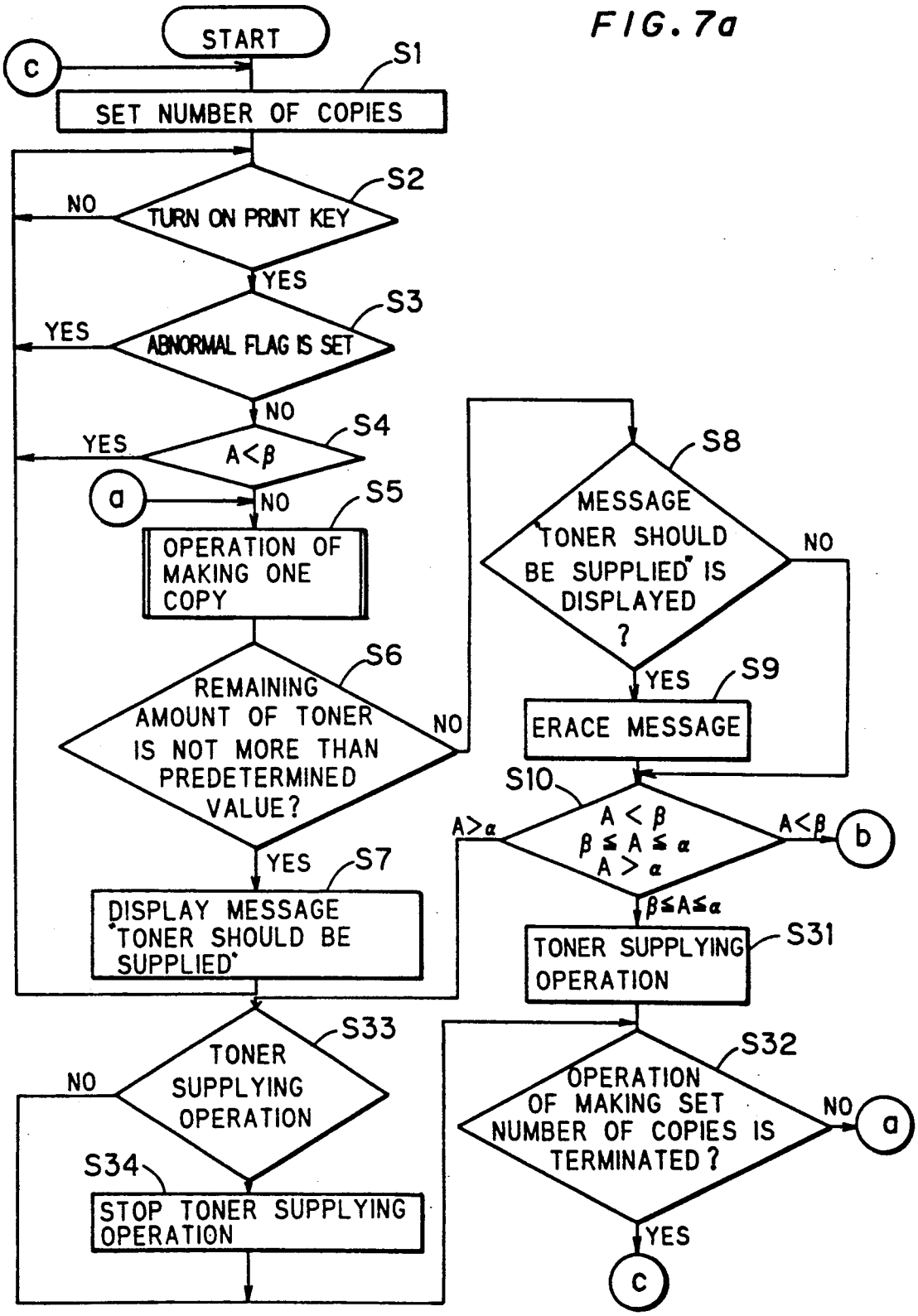

FIGS. 7*a* and 7*b* show the procedure for the toner supply control processing by the CPU 110.

When the number of copies is set after the power supply of the copying machine is turned on (steps S1), and a print key is turned on (step S2), it is judged whether or not an abnormal flag as described later is set (step S3). If the abnormal flag is set, the program is returned to the step S2, that is, copying is inhibited.

When the abnormal flag is not set, it is judged whether or not a toner density A detected by the toner density detector 102 is less than the density for judging copy inhibition $\beta$ (step S4). If the detected toner density A is less than the density for judging copy inhibition $\beta$ ($A<\beta$), the program is returned to the step S2, that is, copying is inhibited.

If the detected toner density A is not less than the density for judging copy inhibition $\beta$, the operation of making one copy is performed (step S5). It is judged on the basis of the detection signal of the toner remaining amount detector 101 whether or not the amount of toner in the toner storage container 32 is not more than a predetermined value (step S6). If the amount of toner in the toner storage container 32 is not more than a predetermined value, a message describing that toner should be supplied is displayed on the display device 124 (step S7), so that the program is returned to the step S2.

A user replaces the toner cartridge 33 with a new one by this message. In this case, the cover 201 is opened. Accordingly, the opened or closed state detecting switch 203 is turned off, so that the driving of the motor 81 is inhibited. Consequently, since the rotating blade 60 is kept in a stopped state while the cover 201 is opened, the user can safely perform the replacing work of the toner cartridge 33.

In a time period from the time when it is judged in the above described step S6 that the amount of toner in the toner storage container 32 is not more than the predetermined value to the time when the toner cartridge 33 is replaced so that the amount of the toner in the toner storage container 32 is more than the predetermined value, the processing in the steps S2 to S7 is repeated. Consequently, even if the set number of copies is plural, continuous copying is inhibited during this time. However, it is possible to make copies one at a time by the operation of the print key. Even if the cover 201 is in its opened state, the driving of the motor 81 is only inhibited. Accordingly, copies one at a time by the operation of the print key are made irrespective of the opened or closed state of the cover 201.

If the amount of the toner in the toner storage container 32 is larger than a predetermined value in the step S6, it is judged whether or not a message describing that toner should be supplied is displayed on the display device 124 (step S8). If the message is displayed, the message is erased (step S9) and then, it is judged whether the toner density A detected by the toner density detector 102 is less than the density for judging copy inhibition $\beta$ ($A<\beta$), is not less than the density for judging copy inhibition $\beta$ nor more than the control reference density $\beta$ ($\beta \leqq A \leqq \alpha$), or is more than the control reference density $\alpha$($A>\alpha$) (step S10).

If the message describing that toner should be supplied is not displayed in the step S8, the program proceeds to the step S10. In the step S10, it is judged whether the toner density A detected by the toner density detector 102 is less than the density for judging copy inhibition $\beta$($A<\beta$), is not less than the density for judging copy inhibition $\beta$ nor more than the control reference density $\alpha$($\beta \leqq A \leqq \alpha$). or is more than the control reference density $\alpha$($A>\alpha$).

When the toner density A detected by the toner density detector 102 is less than the density for judging copy inhibition ($A<\beta$) in the step S10, the copying operation is interrupted so as to perform the toner supplying operation (step S11). Such a situation occurs when copies continue to be made without replacing the toner cartridge 33 with a new one after the amount of the toner in the toner storage container 32 is not more than the predetermined value, and the toner cartridge 33 is replaced with a new one after there occurs a state where no toner exists in the cylindrical member 44.

In order to perform the toner supplying operation, the rotating blade 60 must be rotated and driven. Accordingly, the cover 201 must be brought into its closed state, when the copying operation is interrupted in the above described step S11, therefore, it is judged whether or not the cover 201 is in its closed state (step S12). When the cover 201 is in its opened state, a message describing that the cover 201 should be closed is displayed on the display device 124 (step S13). When the cover 201 is in its closed state or is brought into its closed state, the toner supplying operation is performed (step S14).

The toner supplying operation is performed by driving the motors 81, 82 and 83 and driving the rotating blade 60, the spiral roller 46 and the spiral rollers 22 and 24. At the time of the toner supplying operation, a message describing that toner is being supplied is displayed on the display device 124 (step S15). When the message describing that the cover 201 should be closed is displayed on the display device 124 at the time of starting the toner supplying operation, a message describing that toner is being supplied is displayed in place of the above described message.

It is judged whether or not a predetermined time, for example, two minutes has elapsed since toner started to be supplied (step S16). Unless a predetermined time has elapsed, it is judged on the basis of the detection signal of the toner remaining amount detector 101 whether or not the amount of the toner in the toner storage container 32 is not more than the predetermined value (step S17). If the amount of the toner in the toner storage container 32 is not more than the predetermined value, it is judged whether or not the toner density A detected by the toner density detector 102 is not less than the control reference density $\alpha$ (step S18). If the detected toner density A is less than the control reference density $\alpha$ ($A<\alpha$), the program is returned to the step S16, so that the processing in the steps S16 to S18 is repeated.

In a case where the processing in the steps S16 to S18 is performed, when the detected toner density A is not less than the control reference density $\alpha(A\geqq\alpha)$ in the step S18, the message describing that toner is being supplied is erased (step S19), and the copying operation is resumed (step S20). In this case, if the operation of making a set number of copies is not terminated (step S21), the program is returned to the step S5, so that the operation of making one cop is performed. If the operation of making a set number of copies is terminated (step S21), the program is returned to the step S1.

In a case where the processing in the steps S16 to S18 is performed, when the amount of the toner in the toner storage container 32 is not more than the predetermined value in the step S17, it is judged that the amount of the toner in the toner storage container 32 is not more than the predetermined value by the toner supplying operation, so that the message describing that toner is being supplied is erased (step S22), and a message describing that toner should be supplied is displayed on the display device 124 (step S23). In addition, the copying machine is stopped (step S24), so that this processing is terminated. In this case, the toner cartridge 33 is replaced with a new one by a user to supply toner to the toner storage container 32, so that the copying machine enters a copying enabled state.

In a case where the processing in the steps S16 to S18 is performed, when it is judged in the step S16 that a predetermined time has elapsed since toner started to be supplied, there is a possibility that any abnormality occurs, so that the message describing that toner is being supplied is first erased (step S25), and it is judged whether or not the cover 201 is in its closed state (step S26). When the cover 201 is in its opened state, there is a possibility that the motor 81 is stopped so that the toner supplying operation is not normally performed because the user erroneously opens the cover 201 during the toner supplying operation started in the above described step S14. Accordingly, the copying operation is interrupted so as to perform the toner supplying operation again by closing the cover 201 (step S27) and then, the program is returned to the above described step S13.

When in the above described step S26, the cover 201 is in its closed state, it is judged that any abnormality occurs, so that a message describing that an abnormality occurs is displayed on the display device 124 (step S28), and the abnormal flag is set (step S29). In addition, the copying machine is stopped (step S30), so that this processing is terminated. In this case, fault repair processing is performed by a service man. The abnormal flag is reset after the fault repair processing.

When in the above described step S10, the toner density A detected by the toner density detector 102 is not less than the density for judging copy inhibition $\beta$ nor more than the control reference density $\alpha(\beta\leqq A\leqq\alpha)$, the toner supplying operation is started (step S31). The toner supplying operation is performed by driving the motors 81, 82 and 83 and driving the rotating blade 60, the spiral roller 46 and the spiral rollers 22 and 24.

In this case, if the cover 210 is in its opened state, the motor 81 is not driven, so that the toner supplying operation is not normally performed. However, the toner supplying operation in this case is performed when the toner density A is not less than the density for judging copy inhibition $\beta$. Accordingly, the opened or closed state of the cover 201 is not judged in the present embodiment. Also in this case, the opened or closed state of the cover 201 may be judged to perform the toner supplying operation after the cover 201 is brought into its closed state by displaying the message describing that the cover 201 should be closed when the cover 201 is in its opened state as in the steps S12 to S14.

In the toner supplying operation started in the above described step S31, the copying operation is performed, as usual. If the operation of making a set number of copies is not terminated (step S32), the program is returned to the step S5, so that the operation of making the next one copy is performed. If the operation of making a set number of copies is terminated (step S32), the program is returned to the step S1.

When in the above described step S10, the toner density A detected by the toner density detector 102 is more than the control reference density $\alpha(A>\alpha)$, it is judged whether or not the toner supplying operation is performed (step S33). If the toner supplying operation is performed (step S33), the toner supplying operation is stopped (step S34). If the operation of making a set number of copies is not terminated (step S32) the program is returned to the step S5, so that the operation of making the next one copy is performed. If the operation of making a set number of copies is terminated (step S32), the program is returned to the step S1.

If the toner supplying operation is not performed in the step S31, the program proceeds to the step S32. In the step S32, it is judged whether or not the operation of making a set number of copies is terminated. If the operation of making a set number of copies is not terminated, the program is returned to the step S5, so that the operation of making one copy is performed. If the operation Of making a set number of copies is terminated, the program is returned to the step S1.

According to the above described second embodiment, suitable measures can be taken when there occurs a state where no toner exists in the toner conveying means between the toner storage container 32 and the developer unit 6 even if the toner exists in the toner storage container 32.

According to the above described second embodiment, when the cover 201 is opened, the driving of the rotating blade 60 is inhibited. Accordingly, it is possible to safely perform the replacing work of the toner cartridge 33. In addition, when the cover 201 is opened, the copying operation is not automatically interrupted or inhibited, so that the operating efficiency of the copying machine is not decreased.

Although in the above described second embodiment, the toner cartridge 33 is mounted on the toner storage container 32 to supply toner to the toner storage container 32, the present invention can be applied to a copying machine in which toner is directly supplied to a toner storage container 32 from a toner bottle or the like.

Furthermore, although in the above described second embodiment, description was made of the copying machine in which the toner in the toner storage container 32 is fed to the developer unit 6 by the rotating blade 60 in the toner storage container 32 and the toner conveying means 40 provided between the toner storage container 32 and the developer unit 6, the present invention can be applied to a copying machine in which tones in a toner storage container 32 is fed to a developer unit 6 by only a rotating blade 60 in the toner storage container 32.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In an image forming apparatus in which toner is fed to a developer unit from a toner storage container through toner conveying means provided between the toner storage container and the developer unit, the image forming apparatus being characterized by comprising:

a toner remaining amount detector for detecting not more than a predetermined amount of toner in said toner storage container;

a toner density detector for detecting the density of toner in said developer unit; and means for interrupting the image forming operation to feed the toner to said developer unit from said toner storage container through said toner conveying means when the amount of the toner in said toner ,storage container is larger than the predetermined amount and the density detected by said toner density detector is lower than a predetermined density.

2. The image forming apparatus according to claim 1, wherein toner agitating means for agitating toner is provided in said developer unit, and said toner agitating means in Said developer unit is driven when the toner is fed to said developer unit from said toner storage container through said toner conveying means.

3. The image forming apparatus according to claim 1, which further comprises reporting means for reporting that toner is being supplied while the toner is fed to said developer unit from said toner storage container through said toner conveying means.

4. The image forming apparatus according to claim 1, which further comprises means for stopping the image forming apparatus as well as reporting that toner should be supplied when the amount of the toner in said toner storage container is not more than the predetermined amount before a predetermined time has elapsed since the toner started to be fed to said developer unit from said toner storage container through said toner conveying means.

5. In an image forming apparatus in which toner is fed to a developer unit from a toner storage container through toner conveying means provided between the toner storage container and the developer unit, the image forming apparatus being characterized by comprising:

a toner remaining amount detector for detecting not more than a predetermined amount of toner in said toner storage container;

a toner density detector for detecting the density of toner in said developer unit;

means for interrupting the image forming operation to feed the toner to said developer unit from said toner storage container through said toner conveying means when the amount of the toner in said toner storage container is larger than the predetermined amount and the density detected by said toner density detector is lower than a predetermined density; and means for stopping the image forming apparatus when the density detected by said toner density detector is lower than said predetermined density at the time point where a predetermined time has elapsed since the toner started to be fed to said developer unit from said toner storage container through said toner conveying means.

6. The image forming apparatus according to claim 5, which further comprises reporting means for reporting that an abnormality occurs when the density detected by said toner density detector is lower than said predetermined density at the time point where a predetermined time has elapsed since the toner started to be fed to said developer unit from said toner storage container through said toner conveying means.

7. The image forming apparatus according to claim 1, which further comprises:

a rotating blade for toner supply disposed in said toner storage container and for feeding the toner in said toner storage container to said toner conveying means;

an opened or closed state detector for detecting the opened or closed state of a cover covering an opening for toner supply provided for the main body of the image forming apparatus for supplying toner to said toner storage container; and means for bringing the rotating blade for toner supply provided in said toner storage container into a driving inhibited state when said opened or closed state detector detects the opened state of said cover.

8. In an image forming apparatus in which a rotating blade for toner supply for feeding toner in a toner storage container toward a developer unit is disposed in said toner storage container, and the toner is fed to said developer unit from said toner storage container, the image forming apparatus being characterized by comprising:

an opened or closed state detector for detecting the opened or closed state of a cover covering an opening for toner supply provided for the main body of the image forming apparatus for supplying toner to said toner storage container; and means for bringing the rotating blade for toner supply provided in said toner storage container into a driving inhibited state when said opened or closed state detector detects the opened state of said cover.

9. In an image forming apparatus in which toner in a toner storage container is fed to a developer unit by a rotating blade for toner supply in said toner storage container and toner conveying means provided between the toner storage container and said developer unit, the image forming apparatus being characterized by comprising:

an opened or closed state detector for detecting the opened or closed state of a cover covering an opening for toner supply provided for the main body of the image forming apparatus for supplying toner to said toner storage container; and means for bringing said rotating blade for toner supply into a driving inhibited state when said opened or closed state detector detects the opened state of said cover.

10. The image forming apparatus according to claim 9, which further comprises:

a toner remaining amount detector for detecting not more than a predetermined amount of toner in said toner storage container;

a toner density detector for detecting the density of toner in said developer unit;

first opened or closed state judging means for judging the opened or closed state of said cover on the basis of said opened or closed state detector when the amount of the toner in said toner storage container is larger than a predetermined amount and the density detected by said toner density detector is lower than a predetermined densityl;

first toner supplying means for driving said rotating blade for toner supply and said toner conveying means when said first opened or closed state judging means judges that said cover is in its closed state; and second toner supplying means for reporting that said cover should be closed when said first opened or closed state judging means judges that said cover is in its opened state and driving said rotating blade for toner supply and said toner conveying means when said cover enters its closed state.

11. The image forming apparatus according to claim 10, which further comprises:

second opened or closed state judging means for judging the opened or closed state of said cover on the basis of said opened or closed state detector when the density detected by said toner density detector is lower than said predetermined density at the time point where a predetermined time has elapsed since said rotating blade for toner supply and said toner conveying means were driven by said first or second toner supplying means;

stopping means for stopping the image forming apparatus when said second opened or closed state judging means judges that said cover is in its closed state; and third toner supplying means for reporting that said cover should be closed when said second opened or closed state judging means judges that said cover is in its opened state and driving said rotating blade for toner supply and said toner conveying means when said cover enters its closed state.

12. The image forming apparatus according to claim 10, which further comprises image forming operation interrupting means for interrupting the image forming operation when the amount of the toner in said toner storage container is larger than the predetermined amount and the density detected by said toner density detector is lower than said predetermined density.

13. The image forming apparatus according to claim 12, which further comprises:

second opened or closed state judging means for judging the opened or closed state of said cover on the basis of said opened or closed state detector when the density detected by said toner density detector is lower than said predetermined density at the time point where a predetermined time has elapsed since said rotating blade for toner supply and said toner conveying means were driven by said first or second toner supplying means:

stopping means for stopping the image forming apparatus when said second opened or closed state judging means judges that said cover is in its closed state; and third toner supplying means for reporting that said cover should be closed when said second opened or closed state judging means judges that said cover is in its opened state and driving said rotating blade for toner supply and said toner conveying means when said cover enters its closed state.

* * * * *